United States Patent [19]

Ishiai

[11] Patent Number: 4,759,696

[45] Date of Patent: Jul. 26, 1988

[54] SCROLL COMPRESSOR WITH BIASED-OPEN EXHAUST VALVE

[75] Inventor: Yoshio Ishiai, Ohta, Japan

[73] Assignee: Sanyo Electric Co., Ltd., Moriguchi, Japan

[21] Appl. No.: 2,977

[22] Filed: Jan. 13, 1987

[30] Foreign Application Priority Data

Jul. 17, 1986 [JP] Japan ..... 61-168446

[51] Int. Cl.[4] ..... F04C 18/04; F04C 29/06; F16K 15/14; F16K 21/04

[52] U.S. Cl. ..... 418/55; 418/270; 137/521

[58] Field of Search ..... 418/55, 270; 137/517, 137/521

[56] References Cited

U.S. PATENT DOCUMENTS 4,527,963 7/1985 Terauchi ..... 418/55

FOREIGN PATENT DOCUMENTS

| | | | |
|---|---|---|---|
| 487498 | 4/1918 | France | 137/521 |
| 56-52595 | 5/1981 | Japan | 418/270 |
| 56-28237 | 6/1981 | Japan . | |
| 57-157871 | 9/1982 | Japan | 137/517 |

*Primary Examiner*—John J. Vrablik

*Attorney, Agent, or Firm*—Wenderoth, Lind & Ponack

[57] ABSTRACT

A scroll compressor having a fixed scroll member and an orbiting scroll member. The fixed scroll member has an end plate and a wrap attached to the end plate in an involute curve and, similarly, the orbiting scroll member has an end plate and a wrap attached to the end plate thereof in a juxtaposed relation with the fixed scroll member so that the wraps of the two scroll members are fitted closely together. A check valve is provided so that an exhaust opening of the end plate is always opened when the compressor is in its operation and closed only when the operation is stopped.

2 Claims, 2 Drawing Sheets

SCROLL COMPRESSOR WITH BIASED-OPEN EXHAUST VALVE

BACKGROUND OF THE INVENTION

The present invention relates in general to a gas compressor for, for example, a refrigerating apparatus and an air conditioning system, and more particularly to a scroll compressor in which air or other gas is compressed to increase its pressure. Generally, the scroll compressor has an orbiting scroll member which includes an end plate and a spiral member or wrap formed substantially in an involute curve and attached to one surface of the end plate in an upstanding position, and a fixed scroll member which is formed complementary to the orbiting scroll member and is arranged in a juxtaposed relation with the wraps of both members being fitted closely together. The orbiting scroll member is moved in an orbiting motion while the rotation of it on its own axis is inhibited by an Oldham's ring disposed between, for example, the orbiting scroll member and a main frame or a housing. The orbiting movement of the orbiting scroll member reduces the sealed space or fluid pocket defined by the two scroll members, and thus compresses a gas therein to increase its pressure.

A structure and operational mechanism of the scroll compressor as described above are disclosed in Japanese Patent Publication No. 56-28237 published June 30, 1981, which will be explained presently. With reference to FIG. 4, the scroll compressor 50 has a fixed scroll 53 member having a wrap 52 in an involute curve on an end plate 51, and an orbiting scroll member 56 which is formed complementary to the fixed scroll member 53 and has an end plate 54 and a wrap 55 so that the two scroll members are arranged in a juxtaposed relation with the two wraps being fitted closely together. A stationary member 58 is fixed to the fixed scroll member 53 and an Oldam ring 57 is provided between the stationary member 58 and the orbiting scroll member 56. The fixed scroll member 53 has an exhaust opening 59 at a center of the end plate 51 so that a gas which has been compressed by a gas pocket formed by the wraps of the two scroll members 53, 56 is exhausted from the exhaust opening 59. The exhaust opening 59 is opened and closed by a check valve 61 to prevent a back-flow of a fluid, which has been compressed and exhausted from the exhaust opening 59, to a lower pressure side in the scroll compressor when the operation of the system is stopped so that reverse rotation of the orbiting scroll member is prevented.

However, the scroll compressor disclosed in the above-described Japanese Patent Publication has the disadvantage that the check valve is repeatedly opened and closed during operating thus producing noise.

SUMMARY OF THE INVENTION

An object of the present invention is to provide a scroll compressor having a one-way valve or a check valve which is maintained open during operation of the compressor and closed when the compressor is stopped so that noise arising from the valve operation can be reduced.

According to the present invention there is provided a scroll compressor having a check valve at an exhaust opening of an end plate of a fixed scroll member, wherein the check valve is maintained open during operation of the compressor and closed only when the compressor is stopped.

PREFERRED EMBODIMENTS OF THE INVENTION

Figure 2:
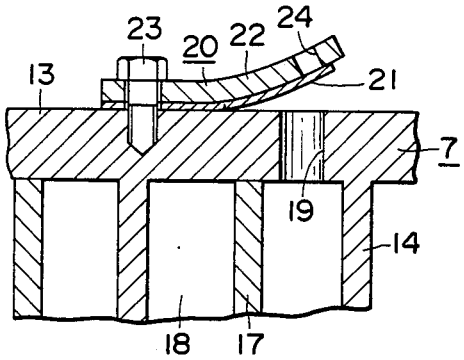
FIG. 2 is a sectional view of a check valve attached to an end plate of a fixed scroll member of the scroll compressor shown in FIG. 1.
Figure 3:
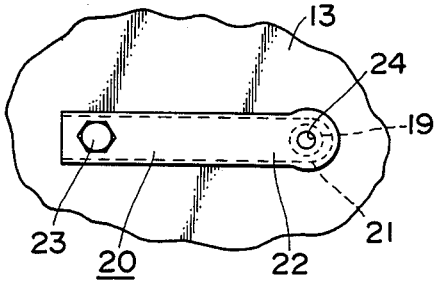
FIG. 3 is a plan view of the check valve shown in FIG. 2.
Figure 4:
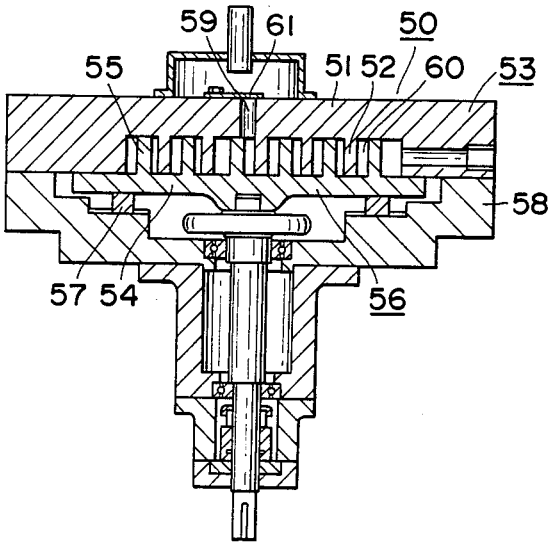
FIG. 4 (PRIOR ART)
FIG. 4 is an illustration of an example of a prior art scroll compressor.

A preferred embodiment of the present invention will be described with reference to FIGS. 1 through 3.

Figure 1:
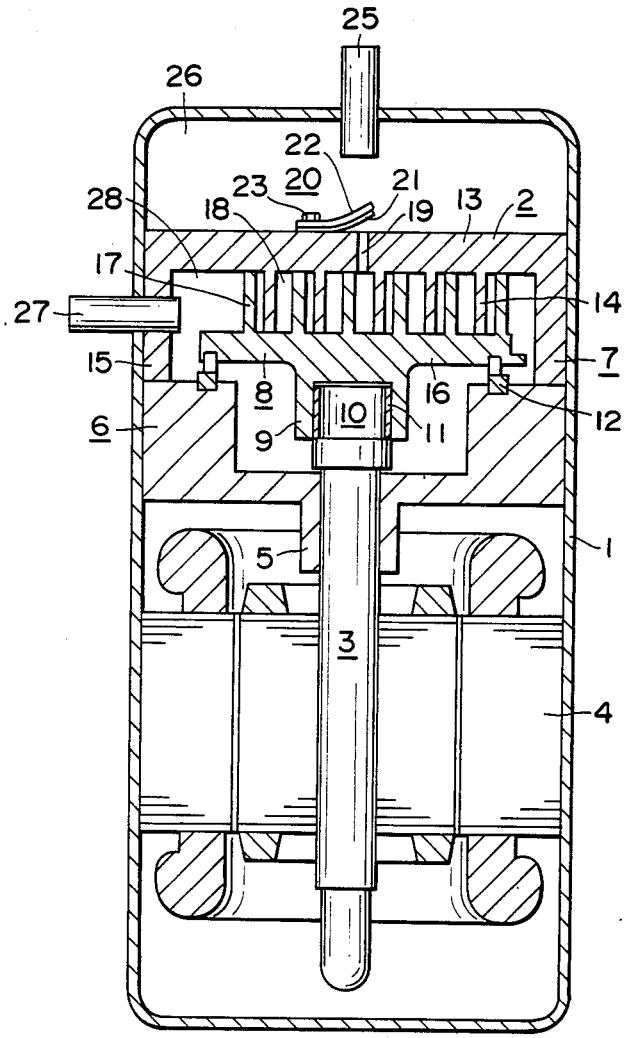
FIG. 1 is a sectional elevation of a scroll compressor according to the present invention.

Referring first to FIG. 1, a hermetically sealed container 1 includes therein a compression device which is generally indicated at 2 at its upper portion and an electric motor 4 at its lower portion. The compression device 2 has a frame 6 which is fixed to an inner surface of the container 1 and has a bearing portion 5 for a driving shaft 3, a fixed scroll member 7 attached to the frame 6 and an orbiting scroll member 8 arranged in a juxtaposed relation with the fixed scroll member 7 with their wraps being fitted closely together, which will be described presently. There is also a slide bearing 11 which journals a crank portion 10 of the driving shaft 3 fitted to a boss 9 of the orbiting scroll member 8, and an Oldham ring 12 which is fitted in the frame 6 to prevent a rotation of the orbiting scroll member 8 relative to the fixed scroll member 7.

The fixed scroll member 7 has an end plate 13, a wrap 14 attached to a surface of the end plate 13 in an upstanding posture and substantially formed in an involute curve, and an annular wall 15 fixed to the frame 6. Similarly, the orbiting scroll member 8 has an end plate 16 positioned inside the annular wall 15 of the fixed scroll member 7, and a wrap 17 attached to a surface of the end plate 16 in an upstanding posture and substantially formed in an involute curve. The fixed scroll member 7 is arranged in a juxtaposed relation with the orbiting scroll member 8 so that the wraps 14, 17 are fitted closely together in an opposed relation to form a gas pocket 18, which is moved toward the center of the wraps as the volume of the gas pocket 18 is decreased.

The fixed scroll member 7 has an exhaust opening 19 formed at a center of the end plate 13 thereof, and a one-way valve or a check valve 20 is disposed adjacent to the exhaust opening 19 on the upper surface of the end plate 13 to thereby prevent a back-flow of a fluid which has been discharged from the exhaust opening 19. With reference to FIGS. 2 and 3, the check valve 20 has a leaf valve 21 and a reinforcing plate 22, which is warped away from the opening 19 as illustrated, and these elements 21, 22 are fixed to the end plate 13 by a bolt 23. The leaf valve 21 is also warped toward the reinforcing plate 22 and away from the exhaust opening 19. The reinforcing plate 22 has an aperture 24 at a warped, extended portion so that a back-flowing fluid can have an effect directly on the leaf valve 21 through the aperture 24. Thus, when the leaf valve 21 is temporarily and unexpectedly adhered to the reinforcing plate 22 by an oil and the like, the exhaust opening 19 is closed by the leaf valve 21 by the effect of the gas. If necessary, the leaf valve 21 can be extended beyond the end of the reinforcing plate 22 to facilitate operation of the valve when the leaf valve 21 is adhered to the reinforcing plate as above. Referring back to FIG. 1, a discharge tube 25 is disposed at an upper wall of the sealed container 1 and opened to an upper chamber 26 above the end plate 13 of the fixed scroll member 7. A suction tube 27 is disposed at an upper side wall of the container and opened to a lower chamber 28.

In operation, the orbiting scroll member 8 is driven by the crank portion 10 of the driving shaft 3 to provide an orbiting movement of the orbiting scroll member 8 relative to the fixed scroll member 7 so that the gas pocket 18 confined by the wraps of the two scroll members 7, 8 is moved to the center thereof as the volume of the gas pocket 18 is decreased gradually. Thus, the gas in the gas pocket 18 is compressed and then moved to the center of the wraps and thereafter exhausted out of the exhaust opening 19. The gas exhausted out of the opening 19 is discharged out of the container 1 through the upper chamber 26.

The leaf valve 21 of the check valve 20 is formed warped toward the reinforcing plate 22 to maintain the exhaust opening open during operation of the compressor holding the leaf valve opening. Thus, noise generated by the valve can be avoided.

When the operation of the compressor is stopped, the pressure difference between the upper chamber 26 and the lower chamber 28 permits the gas in the upper chamber 26 to flow back toward the lower chamber 28 through the exhaust opening 19 and, at that moment, the leaf valve 21 is actuated to close the exhaust opening 19 by the back-flowing gas. Consequently, the gas in the upper chamber 26 does not flow back to the lower chamber 28 through the wraps of the two scroll members 7, 8. Therefore, reverse movement of the orbiting scroll member 8 can be prevented except for slight reverse rotation owing to residual gas left in the gas pocket 18, and noise owing to the reverse rotation of the orbiting scroll member 8 is eliminated.

According to the present invention, the check valve is provided to maintain the exhaust opening open during operation of the compressor so that noise generated by the valve is eliminated, and to close the exhaust opening when the operation of compressor is stopped, thus preventing reverse rotation of the orbiting scroll member.

Although the present invention has been described with reference to the preferred embodiment, many modifications and alterations can be made within the spirit of the invention.

What is claimed is:

1. A scroll compressor comprising:

a fixed scroll member having an end plate and a wrap attached to a surface of said end plate in an involute curve;

an orbiting scroll member having an end plate and a wrap attached to a surface of said end plate of the orbiting scroll member in a juxtaposed relation with said fixed scroll member so that the wraps of the two scroll members are fitted closely together;

said end plate of said fixed scroll member having an exhaust opening to permit a compressed gas to be discharged out of said wraps;

said end plate of said fixed scroll member having a normally-open one-way valve at said exhaust opening for maintaining said exhaust opening always open during operation of the compressor and for closing said exhaust opening only when the operation of the compressor is stopped; and said one-way valve having a leaf valve and a reinforcing plate, said reinforcing plate being warped in a direction away from said exhaust opening, said leaf valve being warped toward and adjacent to said reinforcing plate for maintaining said exhaust opening always open during the operation of the compressor, and said leaf valve being separately movable away from said reinforcing plate for closing said exhaust opening only when the operation of the compressor is stopped.

2. A scroll compressor according to claim 1, wherein said reinforcing plate has an aperture therein for allowing gas therethrough to press against said leaf valve for closing said exhaust opening when the compressor is stopped.

* * * * *